United States Patent [19]

Haller

[11] 4,054,174

[45] Oct. 18, 1977

[54] METHOD OF INHIBITING DEPOSITION OF INTERNAL CORROSION PRODUCTS IN TUBES

[75] Inventor: Kurt H. Haller, Akron, Ohio

[73] Assignee: The Babcock & Wilcox Company, New York, N.Y.

[21] Appl. No.: 619,415

[22] Filed: Oct. 3, 1975

Related U.S. Application Data

[63] Continuation-in-part of Ser. No. 452,248, March 18, 1974, abandoned.

[51] Int. Cl.[2] ..... F28F 19/06

[52] U.S. Cl. ..... 165/1; 165/133; 165/180; 122/DIG. 13

[58] Field of Search ..... 165/1, 133, 180; 122/DIG.13

[56] References Cited

U.S. PATENT DOCUMENTS

| | | | |
|---|---|---|---|
| 149,138 | 3/1874 | Lansdell | 122/DIG. 13 |
| 399,244 | 3/1889 | Converse | 122/DIG. 13 |
| 1,582,407 | 4/1926 | King | 122/DIG. 13 |
| 1,608,694 | 11/1926 | Cain | 122/DIG. 13 |

*Primary Examiner*—Albert W. Davis, Jr.
*Attorney, Agent, or Firm*—J. Maguire; R. C. Mai

[57] ABSTRACT

A method for inhibiting the deposition of porous solid products on the internal surface of fluid conducting tubes in a heat absorbing zone of a steam generating unit by the use of internally plated tubes.

3 Claims, 3 Drawing Figures

| SAMPLE | DEPOSIT WT. GRAM / FT$^2$ | MATERIAL |
|---|---|---|
| 1 | 27.4 | CROLOY 5 - 2" OD x 0.280 WALL |
| 2 | 3.3 | CROLOY 1/2 - 1-31/32" OD x 0.284 WALL- CHROM. PL. |
| 3 | 12.7 | CROLOY 1/2 - 1-31/32" OD x 0.284 WALL- NICKEL PL. |
| 4 | 18.0 | CROLOY 1/2 - 1-31/32" OD x 0.284 WALL |

METHOD OF INHIBITING DEPOSITION OF INTERNAL CORROSION PRODUCTS IN TUBES

This application is a continuation-in-part of U.S. Pat. application Ser. No. 452,248, now abandoned filed Mar. 18, 1974.

BACKGROUND OF THE INVENTION

Since the development of high-pressure boilers, operating at both sub-critical and super-critical pressures, the origin, formation and effects of internal deposits have been a vital concern to the designer. Although, for sustained operation, an extremely limited degree of internal scale formation is desired to protect the base metal from oxidation, the deposition of excess solid products in porous form from the flowing fluid and in a unique wave-like pattern can result in increased frictional and heat transfer resistances and the requirement for frequent cleaning of internal surfaces. This requirement of internal cleaning results in lower availability and costly outage time but is necessary if tube overheating, particularly in the high heat absorbing zones of the furnace, and forced outages are to be prevented. Efforts have been concentrated in the areas of cycle design and water treatment in an attempt to minimize the deposition of water-bearing soluble constituents. Presently, condensate polishing demineralizers are used for total solids control, and dissolved oxygen and carbon dioxide are controlled by deaeration and hydrazine treatment, but the gradual buildup of internal deposits persists. It has been found that even with optimum boiler water conditions, the basic iron and water reaction takes place continuously within a closed cycle. This reaction is a continuous process of deposition, release, transport and redeposition of corrosion products generated within the steam generating unit, in addition to the dissolved solids carried into the steam generating unit from external sources.

SUMMARY OF THE INVENTION

As a result of extensive field and laboratory testing on operating units it has been found that, in accordance with the invention, chrome plating the internal surface of tubes, particularly in the burner or high heat absorbing zones of the furnace, markedly reduces the deposition of internal corrosion products. It is pertinent to clearly distinguish the common use of plated metals to protect the base metal from undergoing a chemical reaction in a corrosive environment and the use of internally plated tubes in a generally noncorrosive environment to inhibit the deposition of solids from the transporting liquid. It is not the purpose or use of the invention to minimize chemical corrosion but to prevent or diminish the mechanical deposition of corrosion products formed elsewhere within the boiler cycle on selected areas within the boiler. Chrome plating has been used to provide corrosion resistance to such items as automobile bumpers and trim and noble metals such as gold and silver have been plated on base metals for oxidation resistance and decorative effects. However, in accordance with the present invention, a novel and unexpected effect has been determined when chrome plating is applied to the internal surface of tubes conducting a fluid in a high heat absorption zone of a furnace which is manifested by a great reduction in deposition of solid products from the fluid flowing within the tube as compared to an adjacent unplated portion of the same tube.

DESCRIPTION OF THE PREFERRED EMBODIMENT

Figure 1:
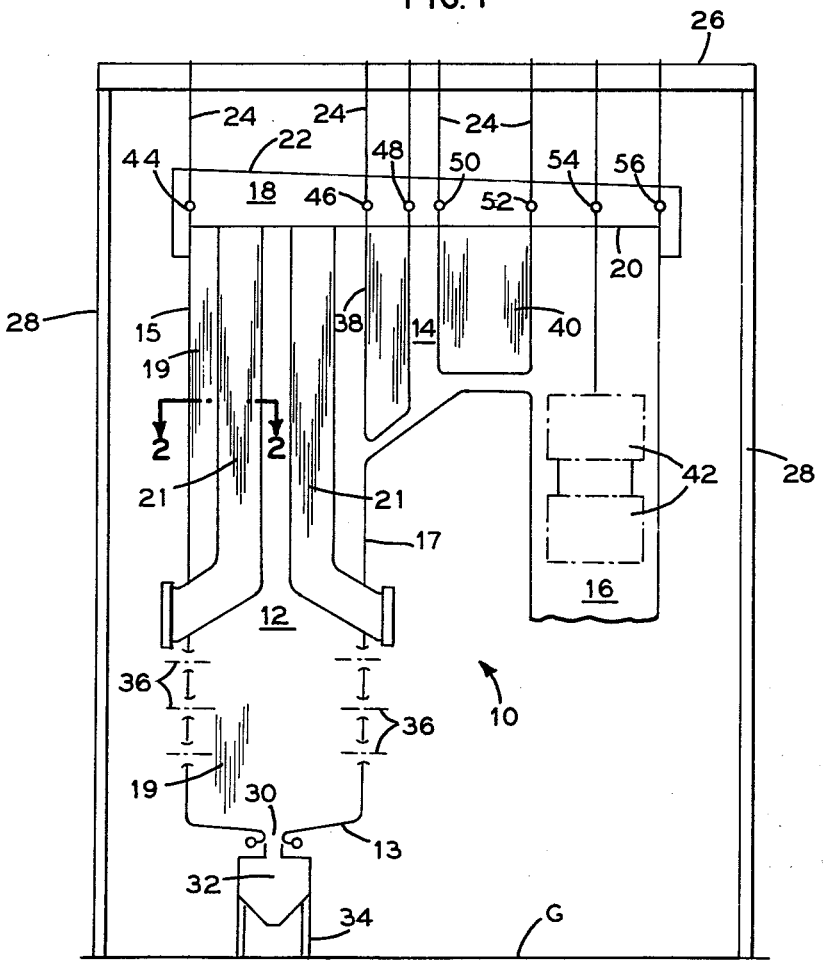
FIG. 1 is a sectional side elevation of a forced flow once-through vapor generator embodying the invention.

In the drawings, the invention has been illustrated as residing in a forced flow once-through vapor generator intended for central station use and specifically in the high heat absorbing zone of the furnace.

The unit, as depicted in FIG. 1, comprises a setting 10bhaving a gas passageway situated therein and including a furnace chamber 12 whose upper end opens for discharge into a horizontal gas passage 14 with the latter, in turn, discharging into a down flow or convection gas passage 16. The setting 10 includes an upper chamber or penthouse 18 disposed above the furnace chamber 12 and the gas passages 14 and 16, and isolated therefrom by a substantially gas-tight partition wall or furnace roof 20. The penthouse 18 extends upwardly from the partition wall 20 and laterally beyond the furnace and gas passage boundary walls to form an insulated chamber for housing headers, tubes and piping associated with the vapor generator. The roof 22 over the setting 10, which also serves as the penthouse roof, accommodates the passage therethrough of a plurality of upright members or rods 24 used to supportingly connect the vapor generator to cross beams 26, the latter being part of the structural steel work which includes upright columns 28 transmitting the weight load of the vapor generator to ground G.

The furnace chamber 12 is formed with a sloped bottom 13 which includes a discharge opening 30 communicating with an ash hopper 32 disposed thereunder and ground supported by a plurality of stanchions 34. The fuel firing equipment comprises independently operable fuel burners (not shown) extending horizontally along the center line of respective burner ports 36 located on the rear and front walls at the lower portion of furnace chamber 12. The furnace chamber 12 is bounded by high heat absorbing surfaces including the sloped bottoms 13, the front wall 15, the rear wall 17, the secondary superheater 38, the partition wall or furnace roof 20, and side walls 19. Within this high heat absorbing zone are contained a multiplicity of division walls 21 spaced between side walls 19.

The gas passage 14 contains a secondary superheater 38 and a reheater 40 arranged in series with respect to gas flow. The gas passage 16 contains a primary superheater 42 having two banks also arranged in series with respect to gas flow.

The penthouse 18 is shown as housing the furnace front wall upper header 44, the secondary superheat inlet and outlet headers 46 and 48, respectively, the reheater outlet and inlet headers 50 and 52, respectively, the primary superheater outlet header 54 and the convection gas pass rear wall header 56. It should be understood that the penthouse normally houses numerous other headers as well as tube sections and piping. These were omitted from FIG. 1 so as not to encumber the illustration.

Figure 2:
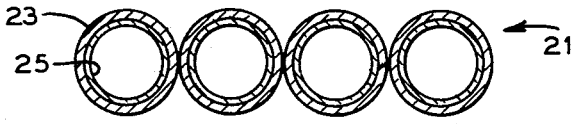
FIG. 2 is a plan view in section of a portion of a furnace division wall taken along the line 2—2 of FIG. 1.

In FIG. 2 there is shown a plan sectional view along the line 2—2 of FIG. 1 of a portion of division wall tubes 21. Individual division wall tubes 23 are shown in tangent relationship and with interior plating 25.

Figure 3:
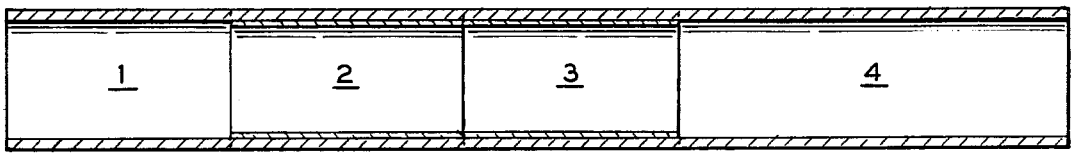
FIG. 3 is a sectional view of a test section installed in the division wall.

FIG. 3 shows a test section of a division wall tube 23 approximately 8 feet long which was installed inban operating unit and removed after approximately 1½years in service. The test section consisted of four different combinations of tube materials and internal tube surface materials which are tabulated in Table 1 with the weight of deposit on each section after this period of service.

Table 1

| Piece Number (FIG. 3) | Material | Deposit Weight grams/ft$^2$ |
|---|---|---|
| 1 | Croloy 5 - Unplated | 27.4 |
| 2 | Croloy ½ - Chromium Plated | 3.3 |
| 3 | Croloy ½ - Nickel Plated | 12.7 |
| 4 | Croloy ½ - Unplated | 18.0 |

This clearly shows the marked decrease in deposition of solid products on the plated sections with the chrome plated section superior to the nickel plated section although this also shows a decrease over the unplated sections. The deposit is porous and consists principally of magnetite, $Fe_3O_4$, in crystalline form with a well-defined regular rippled or wave-like surface pattern with the wave crests at right angles to the longitudinal axis of the tube.

An additional test program was initiated on a second operating unit in a different plant. A 10-foot section of unplated Croloy one-half tubing was removed from the division wall after 6 months service and a magnetite deposit weighing 20 grams per sq. ft. was found. This section of tubing was replaced with a 10-foot section of chromium plated Croloy one-half tubing and after 6 months service under similar conditions the plated section was removed and a deposit weighing 1 gram per sq. ft. was determined, confirming the earlier results on the effectiveness of chrome plating in inhibiting internal deposits.

It will be understood that the invention may be generally applied to the internal surface of all the high heat absorbing tubes of the furnace or wherever the deposition of porous solid products on the internal surface of the tubes presents a problem.

What is claimed is:

1. The method of inhibiting the deposition in solid form on the inside surfaces of heat absorbing vaporizable liquid conducting tubes of suspended solids, consisting principally of magnetite, $Fe_3O_4$, transported by the liquid in the tubes which have their outside surfaces exposed to hot gases and are embodied in a closed cycle vapor generating system wherein almost all of the vapor generated is recovered as condensate and returned to the tubes, which comprises using ferrous metal tubes having a film of a non-ferrous metal on the inside surfaces of the tubes which has been applied in a known manner.

2. The method of claim 1 wherein the film of a non-ferrous metal is chromium.

3. The method of claim 1 wherein the film of a non-ferrous metal is nickel.

* * * * *